US012352435B2

(12) United States Patent
Sighinolfi et al.

(10) Patent No.: US 12,352,435 B2
(45) Date of Patent: Jul. 8, 2025

(54) COMBUSTION MEMBRANE FOR A GAS BURNER

(71) Applicant: BECKETT THERMAL SOLUTIONS S.R.L., Modena (IT)

(72) Inventors: Luca Sighinolfi, Modena (IT); Massimo Gilioli, Modena (IT); Gabriele Gangale, Modena (IT); Ettore Etenzi, Modena (IT)

(73) Assignee: BECKETT THERMAL SOLUTIONS S.R.L., Modena (IT)

( * ) Notice: Subject to any disclaimer, the term of this patent is extended or adjusted under 35 U.S.C. 154(b) by 466 days.

(21) Appl. No.: 17/536,770

(22) Filed: Nov. 29, 2021

(65) Prior Publication Data

US 2022/0170631 A1 Jun. 2, 2022

(30) Foreign Application Priority Data

Nov. 30, 2020 (IT) ..... 102020000029018

(51) Int. Cl.
*F23D 14/14* (2006.01)
*F23D 14/46* (2006.01)
(Continued)

(52) U.S. Cl.
CPC ..... *F23D 14/14* (2013.01); *F23D 14/46* (2013.01); *F23D 14/70* (2013.01); *F23D 14/02* (2013.01);
(Continued)

(58) Field of Classification Search
CPC ..... F23D 14/14; F23D 14/70; F23D 2203/10; F23D 2203/106; F23D 14/02; F23D 14/46; F23D 2203/1012; F23D 2203/1026
(Continued)

(56) References Cited

U.S. PATENT DOCUMENTS

2005/0172915 A1* 8/2005 O'Donnell ..... F23C 5/02 122/17.1
2011/0219957 A1* 9/2011 Fogolin ..... A47J 37/0704 99/450

(Continued)

FOREIGN PATENT DOCUMENTS

EP 0 852 316 A2 7/1998
EP 2 156 096 B1 10/2014
WO 2010/073282 A1 7/2010

OTHER PUBLICATIONS

Italian Search Report for Italian Patent Application No. 102020000029018 mailed Jul. 15, 2021, 8 pages.

*Primary Examiner* — Steven B McAllister
*Assistant Examiner* — Benjamin W Johnson
(74) *Attorney, Agent, or Firm* — Merchant & Gould P.C.

(57) ABSTRACT

A combustion membrane (14, 14') for a gas burner (2) forms a multilayer panel (22) including a gas-permeable diffuser layer (24) of a porous or fibrous solid material other than metal sheet, the diffuser layer (24) forming a combustion surface (25) facing an outer side (17), a support layer (26) formed by a metal sheet (32), arranged on an inner side (23) with respect to the diffuser layer (24), opposite to the combustion surface (25), and connected to the diffuser layer. The metal sheet has a pattern (27) of passage openings (28), a local deviating layer (29), bordering the support layer (26). Diverter flaps (30) bent transversely out of the support layer (26) and delimited by cutting or tearing edges (42) of the support layer metal sheet (32), form guide surfaces (31) oblique to a direction (40) orthogonal to an extension plane (41) of the multilayer panel (22).

12 Claims, 7 Drawing Sheets

(51) Int. Cl.
*F23D 14/70* (2006.01)
*F23D 14/02* (2006.01)

(52) U.S. Cl.
CPC .. *F23D 2203/10* (2013.01); *F23D 2203/1012* (2013.01); *F23D 2203/1026* (2013.01); *F23D 2203/106* (2013.01)

(58) Field of Classification Search
USPC ..... 431/326
See application file for complete search history.

(56) References Cited

U.S. PATENT DOCUMENTS

| | | | | |
|---|---|---|---|---|
| 2014/0000534 | A1* | 1/2014 | Naitoh | F24H 15/215<br>431/12 |
| 2020/0096193 | A1* | 3/2020 | Paniagua | F23D 14/145 |

* cited by examiner

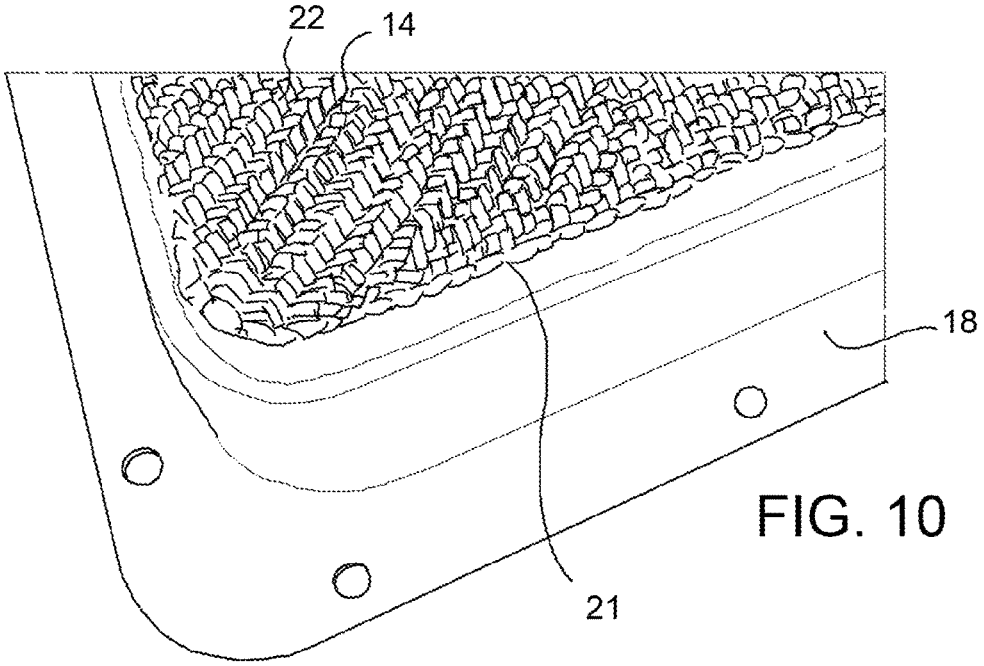
FIG. 10
FIG. 11
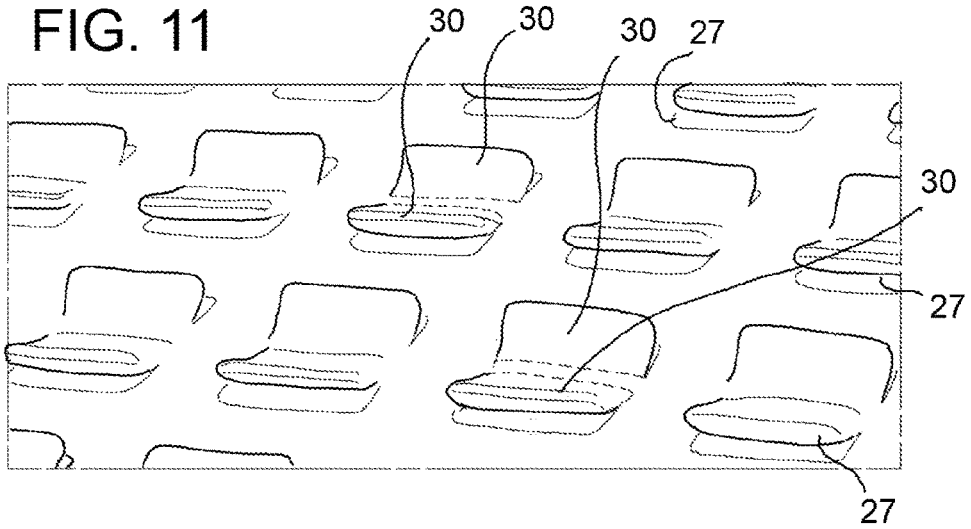
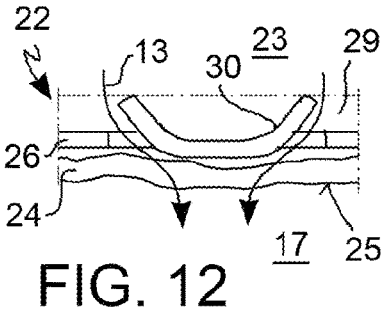
FIG. 12
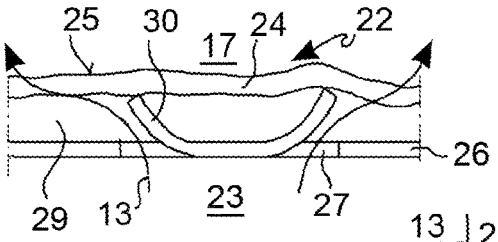
FIG. 13
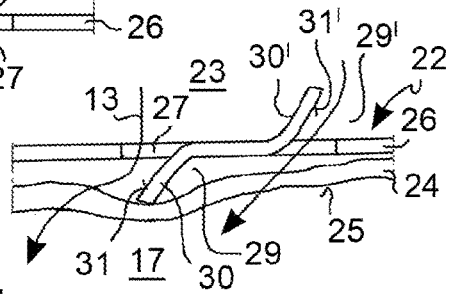
FIG. 14

COMBUSTION MEMBRANE FOR A GAS BURNER

This application claims benefit of Serial No. 102020000029018, filed 30 Nov. 2020 in Italy, and which application is incorporated herein by reference. To the extent appropriate, a claim of priority is made to the above-disclosed application.

BACKGROUND OF THE INVENTION

The present invention relates to a combustion membrane for a burner, in particular for a completely or partially premixed burner, for example for boilers, swimming pool heaters, hot air generators, or ovens for industrial processes.

Gas combustion systems comprise:

- a burner, which is connectable to a combustion chamber of a boiler or another application, for the production of heat by combustion of combustible gas and combustion air inside the combustion chamber,
- a feeding system for feeding combustible gas and combustion air, or a premixed mixture of gas and air, to the burner,
- an ignition system, for example an ignition electrode, for igniting the combustion,
- an ionization sensor arranged at a combustion zone of the burner and adapted to provide an electrical ionization signal which varies as a function of the combustion condition of the burner,
- an electronic control unit, connected to the feeding system, the ignition system and the ionization sensor, and adapted to control the ignition system and the feeding system depending on an operating command or program and depending on the ionization signal.

The feeding system usually comprises a fan, driven by an electric motor, for the suction and conveying of a flow of combustion air, as well as a solenoid valve for controlling a flow of combustible gas.

It is known to conduct the gas and air flows separately in the combustion zone of the burner or to premix the gas and air flows upstream of the burner and feed a single pre-mixed gas and air flow to the burner.

The known ignition systems comprise, for example, an ignition electrode which can be electrically fed to generate a combustion ignition spark.

The known ionization sensors comprise for example an electrode, for example the same ignition electrode to which an electrical signal with known electrical features is fed and which returns an electrical signal with modified electrical features depending on the combustion conditions (for example ionization of the environment, temperature) at the sensor.

It is known to interpret and use the ionization signal supplied by the ionization sensor to check the presence/absence of flame, as well as to actively control the combustion (for example the thermal power or the ratio between combustion air and combustible gas).

The burners of the prior art comprise a combustion membrane having:

- an inner surface in flow communication with the feeding system,
- a diffuser layer forming an outer surface (or combustion surface) of the membrane, facing the combustion chamber,

- in which the gas and air mixture is conveyed through the combustion membrane on the outer side of which the combustion occurs, in the form of a flame pattern on the combustion surface.

A distributor may also be provided upstream of the diffuser layer (with reference to the flow direction of the gas-air mixture) in order to distribute the mixture in a desired manner towards the combustion membrane. The known distributors are generally made as walls with a plurality of through openings, for example made of perforated sheet, and may form an "inner" layer of the combustion membrane or alternatively, a component which is spaced apart from the combustion membrane.

The heat generated by the combustion is directed by the hot combustion gases (convection) and by heat radiation to a heat exchanger to heat a fluid, e.g., water, which is then conveyed to a utility, for example a heating system of an industrial process, residential environments or the like and/or domestic water.

For a desirable and satisfactory use of the burner and the combustion system, on the one hand it is desirable to be able to vary in a controlled manner the heating power of the burner and the flow of combustible gas and combustion air through the combustion membrane and, on the other hand, ensure operation which is as quiet as possible and without mechanical vibrations which are annoying to people or harmful to the burner structure.

To deal with the problem of mechanical vibrations and the noise of gas combustion systems, it is known to provide the burner with accessory structures, for example inserts or diaphragms which locally affect the inert masses of the burner and the fluid dynamic conditions of the gas and air mixture, and thus the dynamic behavior of the burner.

These noise reduction accessories must be optimized for predetermined fluid dynamics and burner combustion conditions and the effectiveness thereof is limited to very narrow operating ranges.

A further disadvantage of the gas burners of the prior art is the limited resistance to high temperatures thereof and the operation thereof with an undesirably non-uniform temperature distribution on the combustion membrane, with undesirable localized temperature peaks. The consequence is damage to the burner structure, in particular to the combustion membrane, and the onset of uncontrollable flame phenomena.

The need is therefore felt to provide further means and strategies for suppressing unwanted thermo-acoustic phenomena in gas burners, in particular in premixed or partially premixed gas burners.

SUMMARY OF THE INVENTION

Therefore, it is the object of the present invention to provide a new and innovative combustion membrane for gas burners and a gas burner, having features such as to obviate at least some of the drawbacks of the prior art.

It is a particular object of the invention to provide a combustion membrane and a gas burner with improved thermo-acoustic properties.

At least part of the objectives of the invention is achieved by a combustion membrane for a gas burner, said combustion membrane forming a curved or planar multilayer panel with an inner side to which a combustible gas is conveyed and an outer side on which the combustion of the combustible gas occurs upon crossing the multilayer panel, said multilayer panel comprising:

a gas-permeable diffuser layer made of a material other than metal sheet, said diffuser layer forming a combustion surface facing the outer side, on which combustion surface the flame develops in a combustion area, a metal sheet support layer, arranged on the inner side with respect to the diffuser layer, opposite to the combustion surface, and connected to the diffuser layer, said metal sheet being in direct contact with the diffuser layer at the combustion area and having a perforation forming a pattern of passage openings at the combustion area, a local deviating layer (29), bordering the support layer (26), in which at the combustion area (8) a plurality of diverter flaps (30), folded transversely out of the support layer (26) and delimited by cutting edges (42) or tearing edges of said metal sheet (32) of the support layer (26), form guide surfaces (31) oblique to a direction (40) orthogonal to an extension plane (41) of the multilayer panel (22).

By virtue of the local deviating layer, during the passage of the combustible gas through the combustion membrane, partial flows of combustible gas are formed along the plane of the membrane itself which positively influence the uniform distribution of the gas, the local cooling of the combustion membrane, the distribution of local flow rate and local gas flow rate over the entire combustion area and, consequently, the thermo-acoustic properties of the combustion membrane and the gas burner.

Furthermore, by making the guide surfaces from metal sheet flaps obtained by cuts in the metal sheet of the support layer, it facilitates making the multilayer panel, facilitates the positioning, the maintenance of the thickness and distance and the mechanical connection between the three functional layers of the panel, in addition to the possibility of providing the guide surfaces with a sharp edge (by virtue of the cut of the metal sheet) which favors a localized detachment of the diverted partial gas flows and, therefore, a localized turbulence which increases the heat exchange and cooling of the combustion membrane. Therefore, a synergistic effect is obtained both from the structural-constructive point of view and from the thermal-acoustic functional point of view.

The object of the invention is further achieved by a gas burner, in particular a partially or completely premixed gas burner, having the aforesaid combustion membrane.

BRIEF DESCRIPTION OF THE DRAWINGS

In order to better understand the invention and appreciate the advantages thereof, a description is provided below of certain non-limiting exemplary embodiments, with reference to the accompanying drawings, in which:

FIG. 10 is a perspective view of a detail of a burner with a combustion membrane according to an embodiment, in which a permeable outer layer of metal fiber fabric of the combustion membrane can be seen, FIG. 11 is a perspective view of a detail of the combustion membrane according to a further embodiment, FIGS. 12, 13 and 14 are sectional views of details of a combustion membrane having a support layer and a local deviating layer according to the detail in FIG. 11.

DETAILED DESCRIPTION OF THE COMBUSTION SYSTEM 1

Figure 1:
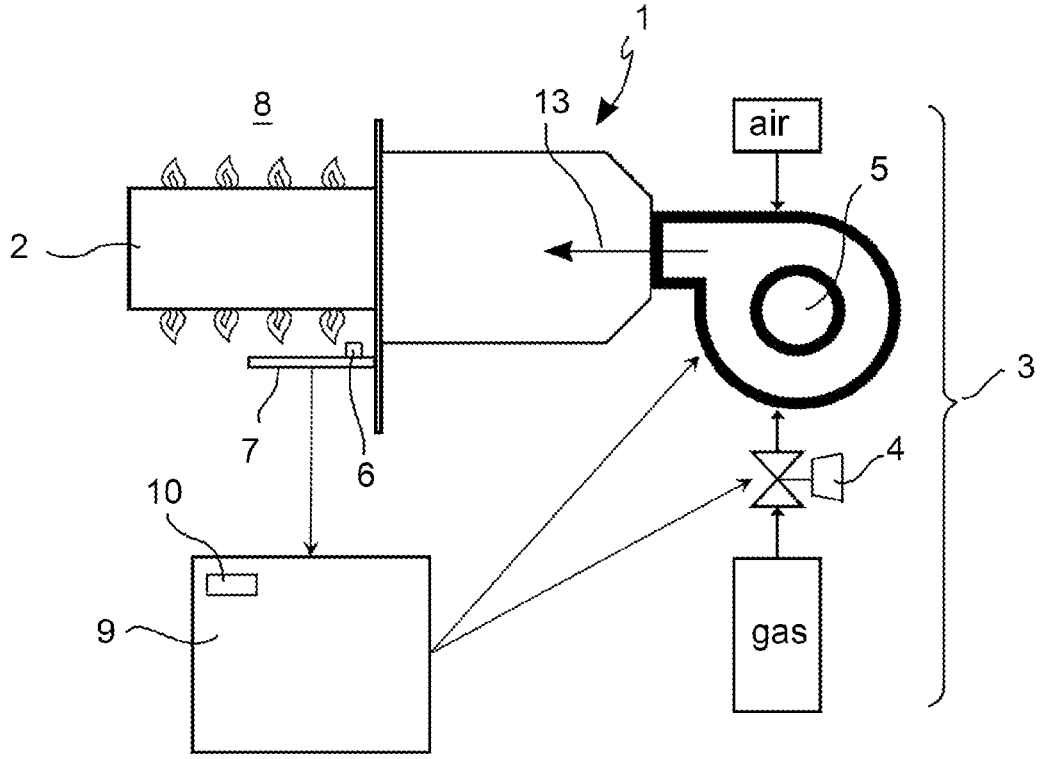
FIG. 1 is a diagrammatic view of a gas combustion system, for example for a boiler, with a burner provided with a combustion membrane according to an embodiment of the invention.

With reference to FIG. 1, a gas combustion system 1, for example for a boiler, comprises:

a burner 2 for producing heat by combustion of combustible gas and combustion air, a feeding system 3 for feeding the combustible gas and combustion air to the burner 2, said feeding system 3 comprising a gas control device 4 for controlling a flow of the combustible gas (e.g., an electrically controllable gas valve or gas conveying means or gas suction means) and an air control device 5 (for example air conveying means or air suction means, an electric fan, a radial fan, an air valve or gate air valve) to control a flow of combustion air, an electric ignition device 6 for igniting the combustion, for example an ignition electrode adapted to generate a spark, an ionization sensor 7 arranged at a combustion area 8 of the burner 2 and adapted to provide an electrical ionization signal which varies as a function of a combustion condition of the burner 2, an electronic control unit 9 connected to the feeding system 3, the ignition device 6 and the ionization sensor 7, the electronic control unit 9 having a combustion control module 10 adapted to control the ignition device 6 and the feeding system 3 depending on an operating program and user commands and depending on the ionization signal,

DETAILED DESCRIPTION OF THE BURNER 2

Figure 2:
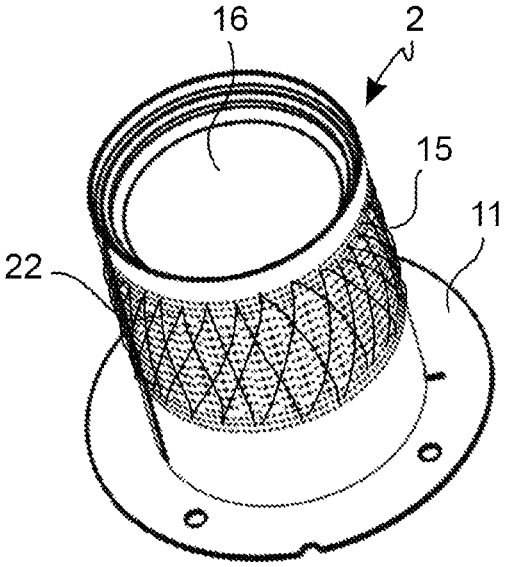
FIGS. 2 and 3 are perspective and sectional views of an exemplary burner, provided with a combustion membrane according to an embodiment.

In accordance with an embodiment (FIGS. 2, 3), the gas burner 2 comprises:

a support wall 11 forming one or more inlet passages 12 for the introduction (of the mixture 13) of combustible gas and combustion air into the burner 2, a tubular combustion membrane 14, for example cylindrical, and coaxial with respect to a longitudinal axis 15 of the burner 2 and having a first end connected to the support wall 11 in flow communication with the inlet passage 12, a second end closed by a closing wall 16, and a perforation for the passage of the gas and air mixture 13 from inside the burner 2 to an outer side 17 of the combustion membrane 14 where the combustion occurs (combustion area 8).

Figure 3:
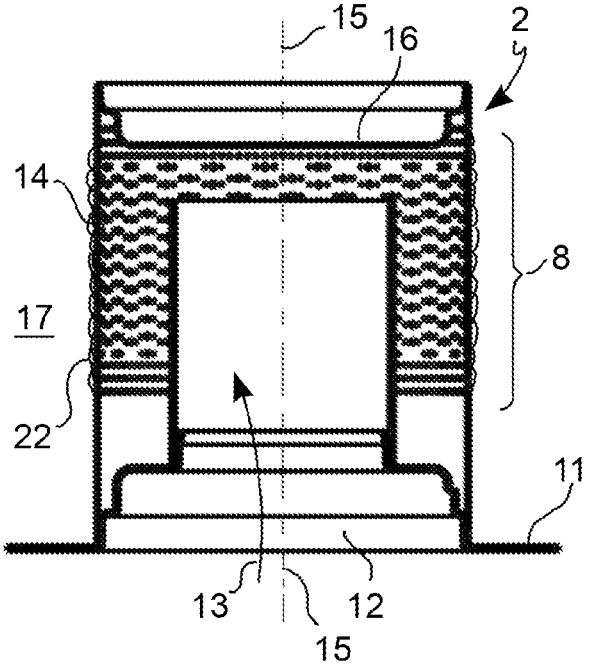

The burner 2 in FIG. 3 further shows a tubular silencing accessory (without reference numeral), which is optional and, by virtue of the innovative combustion membrane 14, such an accessory can be reduced in size or completely eliminated.

According to a further embodiment (FIGS. 4, 5, 6, 7, 8), the gas burner 2 comprises:

a support frame or housing 18 forming for example a lateral wall in the form of a frame 19 and a bottom wall 20, one of which forms one or more inlet passages 12 for the introduction (of the mixture 13) of combustible gas and combustion air inside the burner 2, a substantially flat combustion membrane 14', for example planar or curved or convex, and having a peripheral edge 21 connected to the support housing/frame 18, in particular to the lateral wall 19, in flow communication with the inlet passage 12, as well as a perforation for the passage of the gas and air mixture 13 from inside the burner 2 to an outer side 17 of the combustion membrane 14' where the combustion occurs (combustion area 8).

Figure 4:
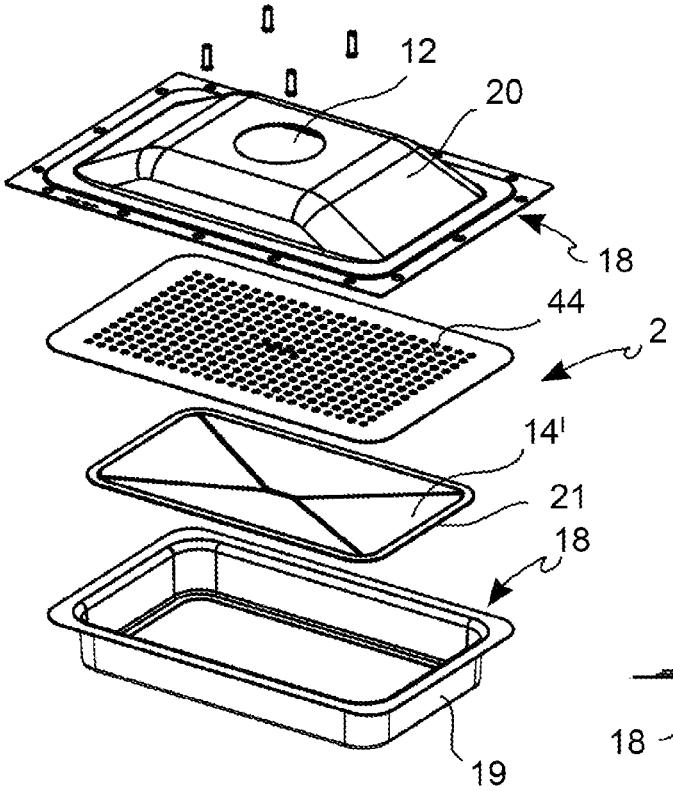
FIGS. 4 and 5 are exploded and lateral perspective views of an exemplary burner, provided with a combustion membrane according to a further embodiment.
Figure 5:
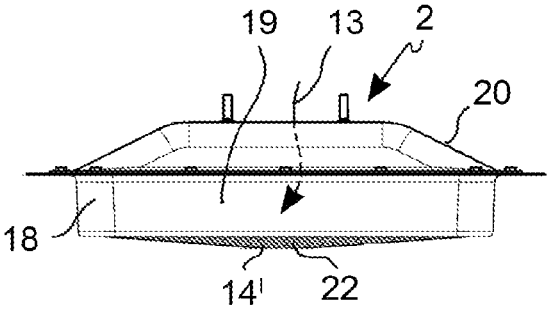
Figure 6:
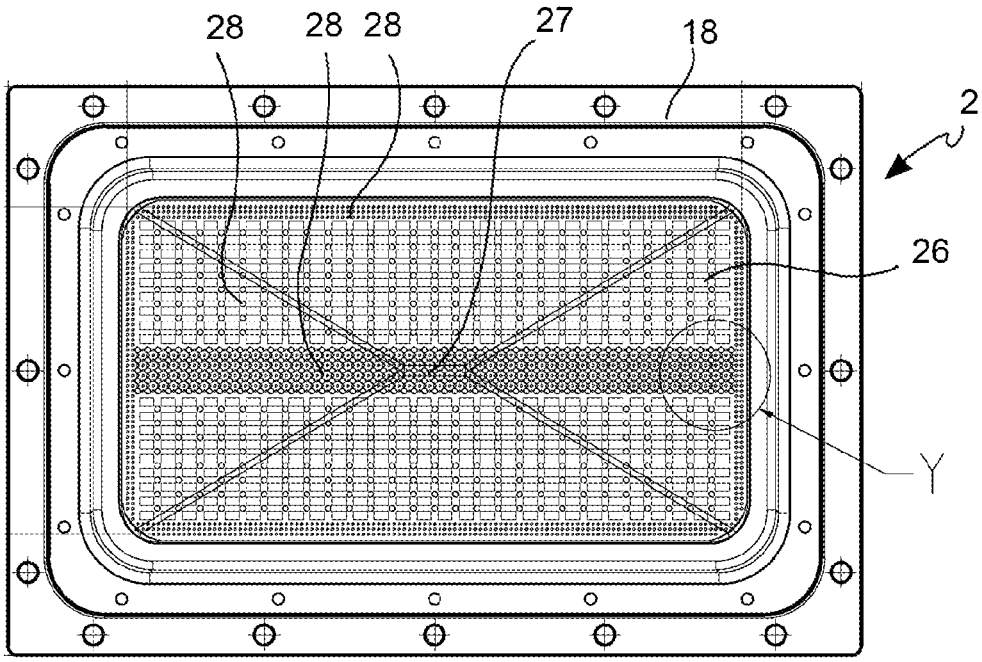
FIGS. 6 and 7 show details of the burner and of the combustion membrane according to an embodiment.
Figure 7:
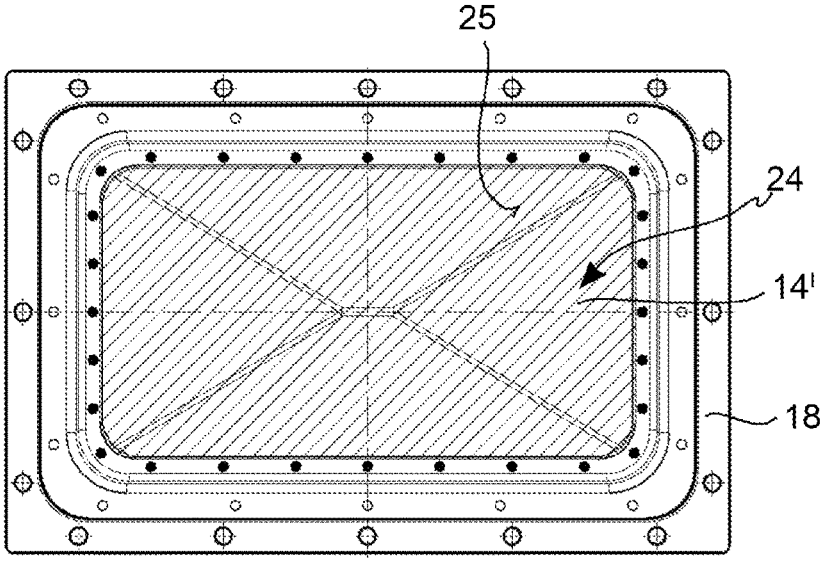
Figure 8:
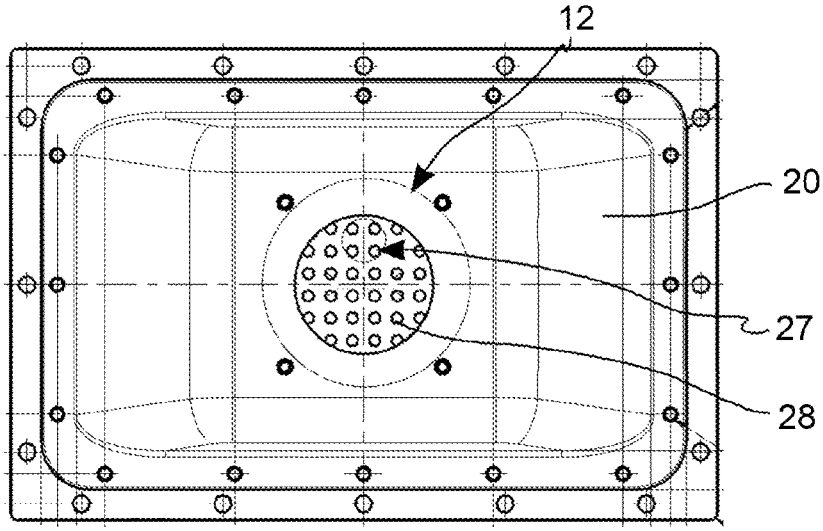
FIG. 8 is a bottom view of a burner according to an embodiment, in which a feeding opening for a gas and air mixture is indicated, as well as a part of an optional distributor of the burner.
Figure 9:
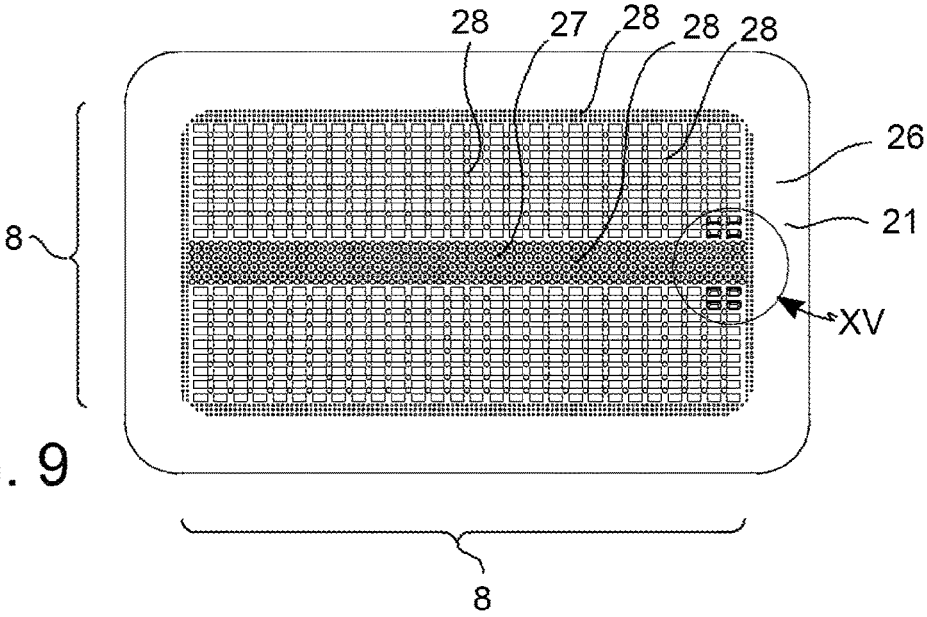
FIG. 9 shows a perforated, locally cut, and deformed metal sheet forming a support layer and a local deviating layer of the combustion membrane according to an embodiment.
Figure 15:
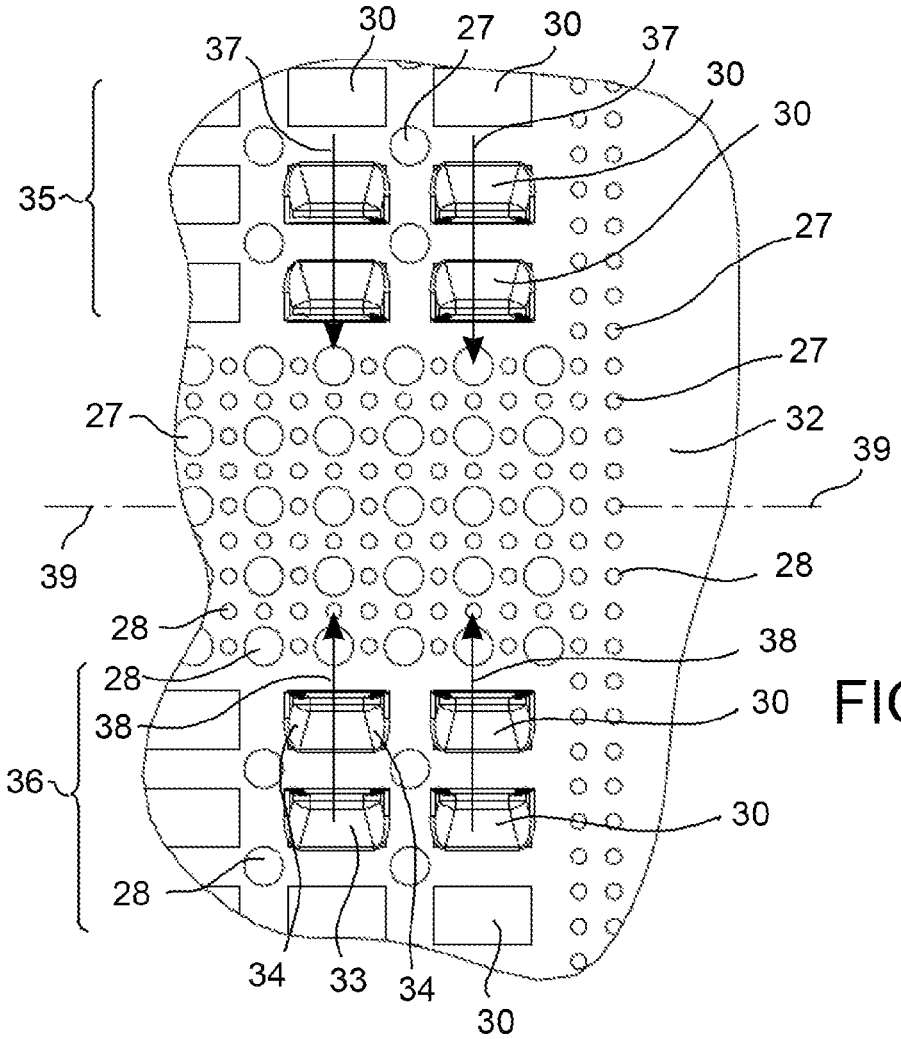
FIG. 15 shows detail XV in FIG. 9, FIGS. 16 to 19 are sectional views of details of a combustion membrane having a support layer and a local deviating layer according to the detail in FIG. 15, FIGS. 20 to 23 are sectional views of details of a combustion membrane according to further embodiments, FIGS. 24A, B, C, D, E, F are sectional views of combustion membranes according to embodiments with patterns of diverter flaps and with arrangement of the diffuser, support, and local deviating layers, different from each other and advantageous.
Figure 16:
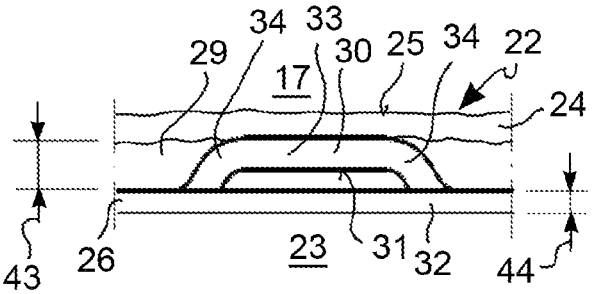
Figure 18:
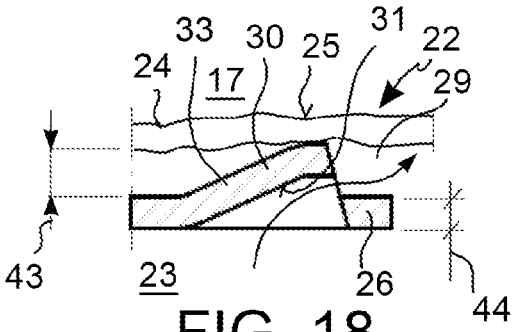
Figure 17:
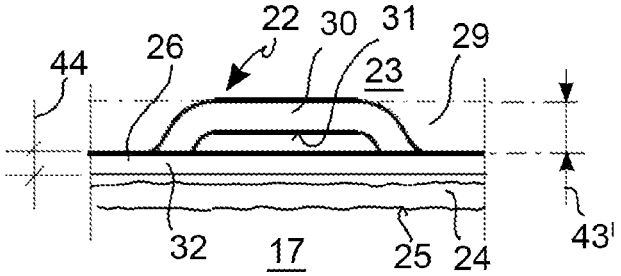
Figure 19:
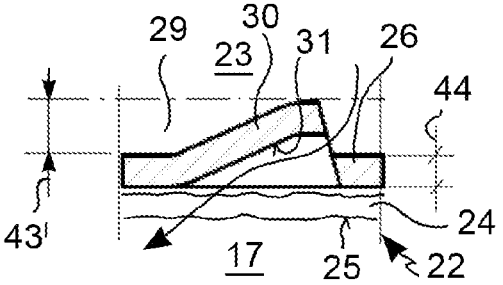
Figure 20:
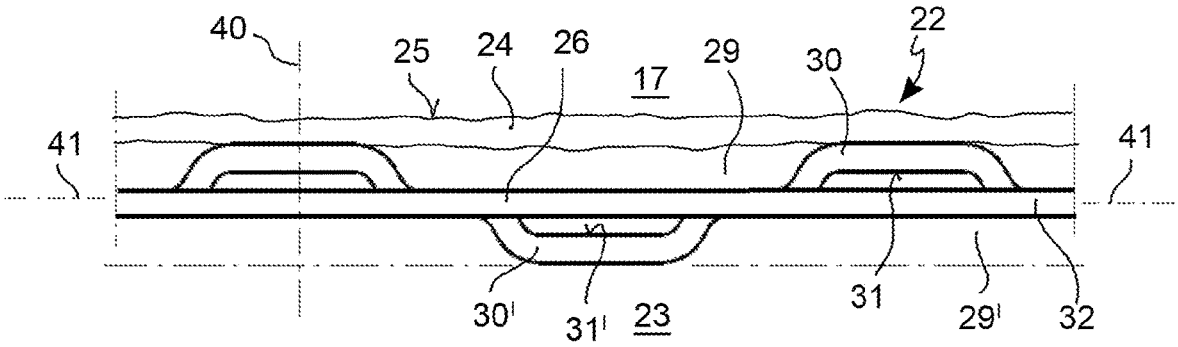
Figure 21:
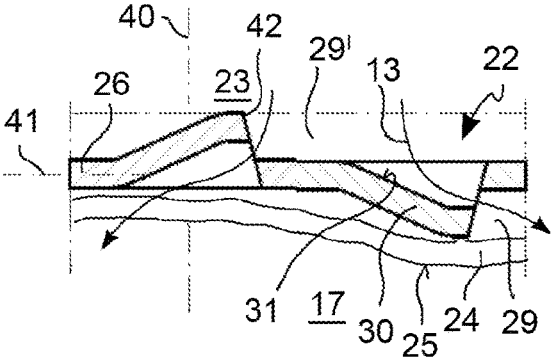
Figure 22:
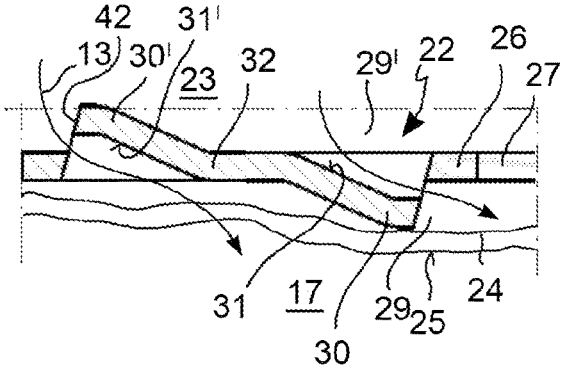
Figure 23:
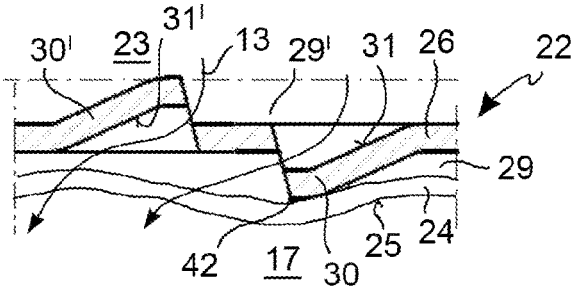
Figure 24:
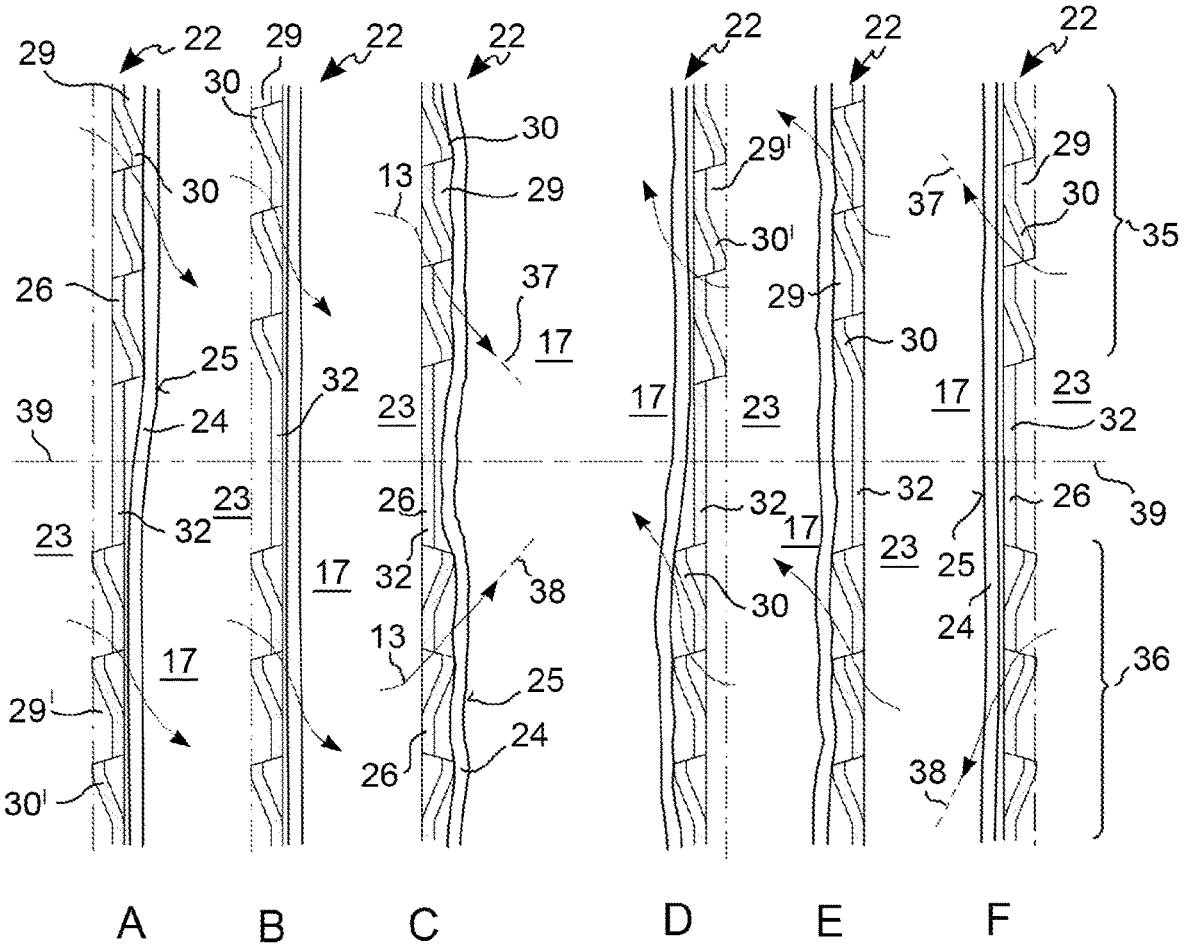

In analogy with prior solutions with traditional combustion membranes, according to an embodiment, in the burner 2, upstream of the combustion membrane 14, 14' (with reference to the flow direction of the combustible gas 13) and spaced therefrom, a perforated distributor wall 44 can be positioned in order to distribute the combustible gas 13 in a desired manner towards the combustion membrane 14, 14' (FIG. 4).

DETAILED DESCRIPTION OF THE COMBUSTION MEMBRANE 14, 14'

The combustion membrane 14 forms a multilayer panel 22, curved or planar according to the shape of the combustion membrane 14, with an inner side 23 to which a combustible gas 13 is conveyed and an outer side 17 on which the combustion of the combustible gas 13 occurs upon crossing the multilayer panel 22, said multilayer panel 22 comprising:

a gas-permeable diffuser layer 24 in a material other than metal sheet, said diffuser layer 24 forming a combustion surface 25 facing the outer side 17, on which combustion surface 25 the flame develops in a combustion area 8, a support layer 26 in metal sheet 32, arranged on the inner side 23 with respect to the diffuser layer 24, opposite to the combustion surface 25, and connected to the diffuser layer 24, said metal sheet 32 being in direct contact with the diffuser layer 24 at the combustion area 8 and having a perforation 27 forming a pattern of passage openings 28 at the combustion area 8, a local deviating layer (29), bordering the support layer (26), in which at the combustion area (8) a plurality of diverter flaps (30), bent transversely out of the support layer (26) and delimited by cutting edges (42) or tearing edges of said metal sheet (32) of the support layer (26), form guide surfaces (31) oblique to a direction (40) orthogonal to an extension plane (41) of the multilayer panel (22).

In accordance with an embodiment, the diffuser layer 24 comprises or consists of:

metal fiber fabric or
metal fiber mesh or
sintered metal fiber panel or
sintered ceramic fiber panel or
composite porous material of ceramic and silicon carbide, or
spongy, solid, heat-resistant open-cell material.

In the context of the present description, fabric means a textile structure with an intertwining of threads or fibers, for example knitted (knitted fabric) or manufactured on a loom by intertwining warp threads with weft threads (loom fabric) according to a determined order and criterion. More specifically, a textile structure is intended with a substantially two-dimensional extension (flat or curved) in space and with a very reduced thickness with respect to the two-dimensional extension.

In accordance with an embodiment (FIGS. 13, 16, 18, 24C, 24E), the local deviating layer 29 is formed (or interposed) between the support layer 26 and the diffuser layer 24. Thereby the diverter flaps 30 space the diffuser layer 24 from the support layer 26 and the locally deviated partial gas flows are generated and extend into the gap between the support layer 26 and the diffuser layer 24.

In accordance with a further embodiment (FIGS. 12, 17, 19, 24B, 24F), the local deviating layer 29 is formed on the inner side 23 with respect to the support layer 26 and, therefore, the support layer 26 is interposed between the local deviating layer 29 and the diffuser layer 24. Thereby, the diverter flaps 30 do not space the diffuser layer 24 from the support layer 24 and the locally deviated partial gas flows are already generated upstream of the support layer 24 and penetrate and extend obliquely into the diffuser layer 24. This allows a support of the diffuser layer 24 on the support layer 26 in an almost continuous manner on the metal sheet 32 and thus a perfectly complementary shape of the two layers 24, 26.

In accordance with a further embodiment (FIGS. 14, 20, 21, 22, 23, 24A, 24D), the multilayer panel 22 forms a further additional deviating layer 29', which is also adjacent to the support layer 26, but on a side opposite to the local deviating layer 29, in which (a pattern of) a plurality of additional diverter flaps 30' projecting transversely out of the support layer 26 at the combustion area 8, form guide surfaces 31' of the flow of combustible gas 13 oblique to the direction 40 orthogonal to the extension plane 41 of the multilayer panel 22, in which said additional diverter flaps 30' are formed by further cutting (or tearing) edges 42 of said metal sheet 32 of the support layer 26.

By virtue of the combination of the local deviating layer 29 and the further additional deviating layer 29', during the passage of the combustible gas through the combustion membrane 14, partial flows of combustible gas 13 are formed along the plane of the combustion membrane 14 itself, or at least oblique, which are generated or diverted partly upstream of the support layer 26 and partly downstream of the support layer 26 and which positively influence the uniform distribution of the gas, the local cooling of the combustion membrane, the distribution of local flow rate and local gas flow rate over the entire combustion area and, consequently, the thermo-acoustic properties of the combustion membrane and the gas burner.

With two separate and distinct layers of flow deviation on two opposite sides of the metal sheet 32, it is easier to obtain for example flow deviations in different directions, being able to perform a cutting and deformation step with a press or punching machine on one side and a second cutting and deformation step with a press or punching machine on the opposite side.

Furthermore, with two separate and distinct flow deviating layers on two opposite sides of the metal sheet 32, it is easier to design and control the local directions of the diverted partial flows.

According to an embodiment, the diverter flaps 30 and/or the additional diverter flaps 30' may have a substantially rectangular (FIG. 11) or triangular and semi-circular shape bent obliquely out of the plane of the metal sheet 32 of the support layer 26.

In accordance with a further embodiment, the diverter flaps 30 and/or the additional diverter flaps 30' may have the shape of a pocket (FIGS. 15-19) projecting from the metal sheet 32 of the support layer 26 and having a main guide wall 33 and two opposite lateral guide walls 34, bent with respect to the main guide wall 33 and with respect to the sheet plane of the support layer 26.

In accordance with a further embodiment, the diverter flaps 30 and/or the additional diverter flaps 30' may comprise a first set of flaps 35 and a second set of flaps 36, in which all the diverter flaps 30 and/or diverter flaps 30' of the first set of flaps 35 determine a first partial flow direction 37 of the combustible gas 13 and all the diverter flaps 30 and/or additional diverter flaps 30' of the second set of flaps 36 determine a second partial flow direction 38 of the combustible gas 13, different from the first partial flow direction 37.

According to an embodiment (FIGS. 12, 15, 24C), the first partial flow direction 37 and the second partial flow direction 38 of the combustible gas 13 are substantially opposite and face each other, or directed by two opposite sides of a reference plane 39, for example a central plane of the burner 2 or a plane of symmetry of the combustion membrane 14, towards said reference plane 39.

According to a further embodiment (FIGS. 13, 21, 24F), the first partial flow direction 37 and the second partial flow direction 38 of the combustible gas 13 are substantially directed away from each other, or directed from two opposites sides of a reference plane 39, for example a central plane of the burner 2 or a symmetrical plane of the combustion membrane 14, away from said reference plane 39.

According to a further embodiment (FIGS. 15, 24A, 24B, 24D, 24E, 24F), sets of pluralities of diverter flaps 30 and/or sets of pluralities of said additional diverter flaps 30' form substantially parallel guide surfaces 31 and/or additional guide surfaces 31' and determine substantially parallel partial flow directions.

According to a further embodiment (FIGS. 14, 22, 23, 24D, 24E), a plurality of the diverter flaps 30 and a plurality of the additional diverter flaps 30' form substantially parallel guide surfaces 31 and supplementary guide surfaces 31' and determine substantially parallel partial flow directions.

According to a further embodiment (FIG. 15), said passage openings 28 comprise passage openings formed in the plane of the metal sheet 32 and spaced from the diverter flaps 30 and, if provided, from the additional diverter flaps 30'.

According to an embodiment (FIG. 15), the passage openings 28 spaced from the diverter flaps 30 and, if included, from the additional diverter flaps 30', are arranged in a regular pattern, in which one or more of said planar passage openings 28 are alternated respectively with one or more of said diverter flaps 30 and/or, if provided, the additional diverter flaps 30'.

According to an embodiment, the passage openings 28 comprise passage openings 28 formed at the diverter flaps 30 and, if provided, the additional diverter flaps 30'.

According to a further embodiment (FIGS. 16, 17, 18, 19), a thickness 43, 43' of the local deviating layer 29 and/or of the additional deviating layer), i.e., an extension of the diverter flaps 30 or, if provided, additional diverter flaps 30', outside the support layer 26, is less than 5 times, preferably less than 3 times, advantageously equal to approximately twice, the thickness 44 of the support layer 26 corresponding to the thickness of the metal sheet 32.

The term "combustible gas 13" denotes:

- combustible gases intended for combustion together with primary combustion air, conveyed to the combustion region 8 through the burner 2 but not necessarily together with the combustible gas, or
- combustible gases intended for combustion together with primary combustion air, conveyed to the combustion region 8 from outside the burner 2, or
- a complete or partial premixture of combustible gas and combustion air fed into the burner 2.

The term "diverter flap" denotes a portion of bent metal sheet (with respect to the surrounding metal sheet) and having at least one free cutting or tearing edge moved transversely with respect to the metal sheet surrounding the diverter flap.

The term "at the combustion area" is not limited to the point where the combustion occurs on the outer side of the combustion membrane, but also denotes the orthogonal projection (on the local plane of the multilayer panel) of the combustion area on each of the layers of the combustion membrane, including the layers positioned inside with respect to the combustion surface and thus not directly in contact with the flame.

Using the combustion membrane 14, 14' in partially or completely premixed burners 2 is particularly advantageous, due to the sensitivity of the premixed burners to thermo-acoustic phenomena, and due to the fact that the combustion membrane 14, 14' improves the thermo-acoustic properties of premixed burners more significantly than non-premixed burners.

The invention claimed is:

1. A combustion membrane for a gas burner, said combustion membrane forming a curved or planar multilayer panel with an inner side to which a combustible gas is conveyed and an outer side on which combustion of the combustible gas occurs upon crossing the multilayer panel, said multilayer panel comprising:

- a gas-permeable diffuser layer made of a porous or fibrous solid material other than metal sheet, said diffuser layer forming a combustion surface facing the outer side, on which combustion surface the flame develops in a combustion area;
  - a support layer formed by a metal sheet, arranged on the inner side with respect to the diffuser layer, opposite to the combustion surface, and connected to the diffuser layer, said metal sheet having a perforation forming a pattern of passage openings at the combustion area, and parts of said metal sheet being in direct contact with the diffuser layer at the combustion area;
  - a local deviating layer, bordering the support layer, wherein at the combustion area a plurality of diverter flaps, folded transversely out of the support layer and delimited by cutting or tearing edges of said metal sheet of the support layer, form guide surfaces oblique to a direction orthogonal to an extension plane of the multilayer panel;

wherein the diverter flaps have a shape of a bottomless pocket, projecting from the metal sheet of the support layer and having a main guide wall and two opposite lateral guide walls, bent with respect to the main guide wall and with respect to the metal sheet plane of the support layer;

wherein the diverter flaps comprise a first set of flaps and a second set of flaps, wherein all the diverter flaps of the first set of flaps determine a first partial flow direction of the combustible gas and all the diverter flaps of the second set of flaps determine a second partial flow direction of the combustible gas, different from the first partial flow direction;

wherein both the first set of flaps and the second set of flaps extend in said local deviating layer on a same one of the inner side or the outer side with respect to the support layer;

wherein the passage openings are formed in a plane of the metal sheet and spaced apart from the first set of flaps and the second set of flaps, and the passage openings are alternated with one or more flaps of said first set of flaps and one or more flaps of said second set of flaps; and wherein the first partial flow direction and the second partial flow direction of the combustible gas are substantially opposite and face each other.

2. A combustion membrane according to claim 1, wherein the diffuser layer is a layer of metal fibers or porous ceramic material or composite porous ceramic and silicon carbide material.

3. A combustion membrane according to claim 1, wherein the local deviating layer is formed between the support layer and the diffuser layer and the diverter flaps separate the diffuser layer from the support layer.

4. A combustion membrane according to claim 1, wherein the local deviating layer is formed on the inner side with respect to the support layer and the support layer is interposed between the local deviating layer and the diffuser layer.

5. A combustion membrane according to claim 1, wherein the multilayer panel forms a further additional deviating layer, which borders the support layer, the further additional deviating layer being arranged on an opposite side with respect to the local deviating layer;

wherein in the additional deviating layer, a plurality of additional diverter flaps folded transversely out of the support layer at the combustion area and delimited by further cutting or tearing edges of said metal sheet of the support layer form additional guide surfaces oblique to the direction orthogonal to the extension plane of the multilayer panel.

6. A combustion membrane according to claim 5, wherein the additional diverter flaps comprise a first set of flaps and a second set of flaps, wherein all the additional diverter flaps of the first set of flaps determine a first partial flow direction of the combustible gas and all the additional diverter flaps of the second set of flaps determine a second partial flow direction of the combustible gas, different from the first partial flow direction.

7. A combustion membrane according to claim 1, wherein sets of pluralities of diverter flaps form substantially parallel guide surfaces and determine substantially parallel, localized partial flow directions.

8. A combustion membrane according to claim 1, wherein said passage openings comprise passage openings formed in the plane of the support layer and spaced apart from the diverter flaps.

9. A combustion membrane according to claim 1, wherein said local deviating layer, defined by the transverse size of the diverter flaps is less than 5 times the thickness of the support layer which corresponds to the thickness of the metal sheet.

10. A combustion membrane according to claim 1, wherein said local deviating layer, defined by the transverse size of the diverter flaps is less than 3 times the thickness of the support layer which corresponds to the thickness of the metal sheet.

11. A combustion membrane according to claim 1, wherein said local deviating layer, defined by the transverse size of the diverter flaps is equal to about twice the thickness of the support layer which corresponds to the thickness of the metal sheet.

12. A premixed gas burner, comprising a combustion membrane according to claim 1.

* * * * *